United States Patent [19]

Moser et al.

[11] Patent Number: 4,477,132

[45] Date of Patent: Oct. 16, 1984

[54] CONNECTOR FOR TWIN AXIAL CABLE

[75] Inventors: Jessie L. Moser, Highpoint; John D. West, Walkertown, both of N.C.

[73] Assignee: AMP Incorporated, Harrisburg, Pa.

[21] Appl. No.: 433,064

[22] Filed: Oct. 6, 1982

[51] Int. Cl.[3] ..... H01R 4/66

[52] U.S. Cl. ..... 339/14 P; 339/89 C; 339/107; 339/177 R

[58] Field of Search ..... 339/14, 176 MF, 177, 339/210, 196, 105, 107, 89 C, 90 C

[56] References Cited

U.S. PATENT DOCUMENTS

| | | | |
|---|---|---|---|
| 1,060,822 | 5/1913 | Crosher | 339/105 |
| 2,983,779 | 5/1961 | Dumire et al. | 339/177 R |
| 3,013,107 | 12/1961 | Boettler | 339/105 |
| 3,144,292 | 1/1961 | Forney, Jr. | 339/128 |
| 3,246,282 | 4/1966 | Mas et al. | 339/210 R |
| 3,441,658 | 4/1969 | Stark et al. | 174/88 |
| 3,611,271 | 10/1971 | Knapp | 339/177 E |
| 4,129,352 | 12/1978 | Iizuka | 339/177 R |
| 4,174,874 | 11/1979 | Lee | 339/14 P |
| 4,270,832 | 6/1981 | Tanabe | 339/105 |
| 4,307,926 | 12/1981 | Smith | 339/177 R |

FOREIGN PATENT DOCUMENTS

| | | | |
|---|---|---|---|
| 1444579 | 10/1966 | France | 339/89 |
| 914326 | 4/1958 | United Kingdom | 38/ |

*Primary Examiner*—John McQuade
*Assistant Examiner*—David L. Pirlot
*Attorney, Agent, or Firm*—Robert W. J. Usher

[57] ABSTRACT

An electrical connector comprising a metal sleeve having a locking cap rotatably mounted on the sleeve to extend from a mating end, a generally cylindrical, insulating, terminal-locating block receivable as a close fit within the sleeve to locate terminals projecting from the mating end and a retention bush to retain the terminal-locating block in the sleeve. The block is bipartite, each part being generally hemicylindrical and being formed with terminal-receiving recesses at a mating end communicating with a cable-receiving recess at a rear end across which extends a cable-clamping rib, a drain wire-receiving passageway extending radially through the body.

5 Claims, 4 Drawing Figures

CONNECTOR FOR TWIN AXIAL CABLE

The invention relates to an electrical connector for a shielded flat cable known as twin axial cable.

The increasing demand for flat cable for example for undercarpet wiring applications has resulted in the development of a flat cable known as twin axial cable to supercede twisted pair coaxial cable.

There is a requirement for a connector which will not only quickly and effectively terminate the twin axial cable, but which will also mate with existing conventional connectors for twisted pair coaxial cable. In addition, it is clearly desirable that a minimum amount of retooling is necessary to minimize capital investment.

A known electrical connector comprises a metal sleeve having spring contact fingers extending from a forward, mating end, a locking cap rotatably mounted on the sleeve to extend from the mating end surrounding the spring contact fingers, a generally cylindrical insulating, terminal-locating block receivable as a clsoe fit within the sleeve to locate terminals projecting from the mating end within and isolated from the spring contact fingers and a retention bush attachable to the rear end of the sleeve to retain the terminal-locating block in the sleeve.

In the twisted pair coaxial cable connector, means are also provided to connect the cable shield to the metal sleeve, such means comprising a ferrule and a metal annulus receivable over the ferrule to clamp the cable shield between them, a resilient washer also being necessary to locate the shield connecting means within the sleeve, clamped between the retention bush and the insulating block.

Prior attempts to locate twin axial cable in the sleeve have included potting to provide necessary strain relief. However, this potting step is very laborious and time-consuming in the field and results in a permanent connection preventing disassembly and reuse of components in the event of a faulty connection.

According to the invention, for terminating twin axial cable, the terminal-locating block is bipartite, each part being generally hemicylindrical and being formed with terminal-receiving recesses at a mating end communicating with a cable-receiving recess at a rear end across which extends a cable-clamping rib, a drain wire-receiving passageway extending radially through the block in communication with the cable-receiving recess.

Assembly of the cable in the connector, after termination of the conductors to the terminals (e.g., by soldering), is easily achieved by threading the terminals and prepared end of the cable through the retention bush and locating the terminals and prepared end in one block part with the drain wires extending through the radial passageway to the exterior of the block and the cable extending across the rib. The other block part is then assembled to the one block part and the subassembly of the insulating block part and terminated cable inserted into the rear of the sleeve. The retention bush is then attached to the rear end of the sleeve.

During the insertion, the drain wires are wedged between the outer surface of the insulating block and the interior surface of the sleeve providing the necessary shield connection while the cable is clamped between the opposed ribs providing the necessary strain relief.

Clearly the connector is easily assembled and provides effective strain relief without a requirement for potting, enabling rapid disassembly if necessary.

The only new component required is the bipartite locating block. The sleeve, locking cap and retention bush of the connector assembly designed for the twisted pair coaxial cable may all be used for the twin axial connector, minimizing retooling investment. In addition, fewer individual components are required for the termination of the twin axial cable than for the twisted pair coaxial cable.

Examples of the invention will now be described with reference to the accompanying drawings in which:

FIG. 3 is a partly exploded perspective view with the terminal-locating block parts assembled together; and, FIG. 4 is a perspective view of modified block parts.

Figure 1:
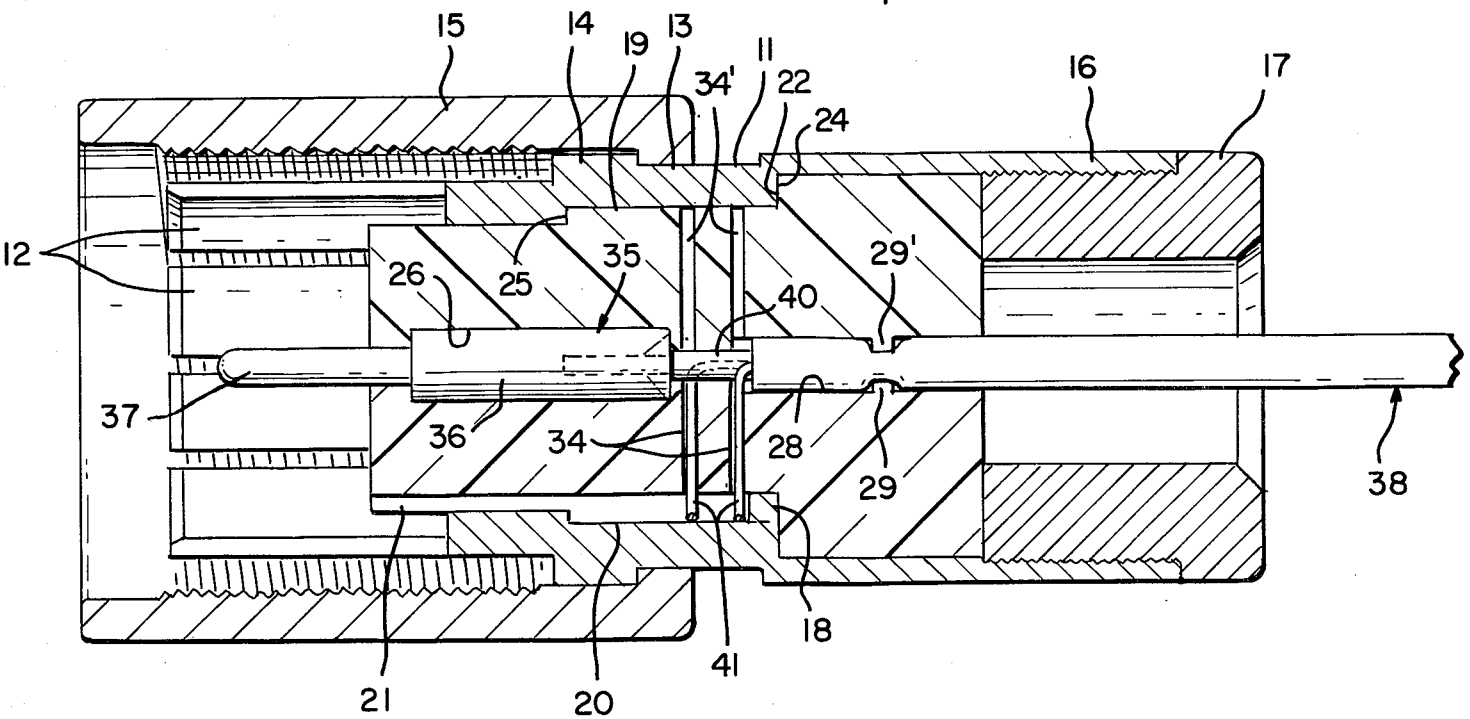
FIG. 1 is an axial cross-sectional view of the connector terminating a twin axial flat cable.
Figure 2:
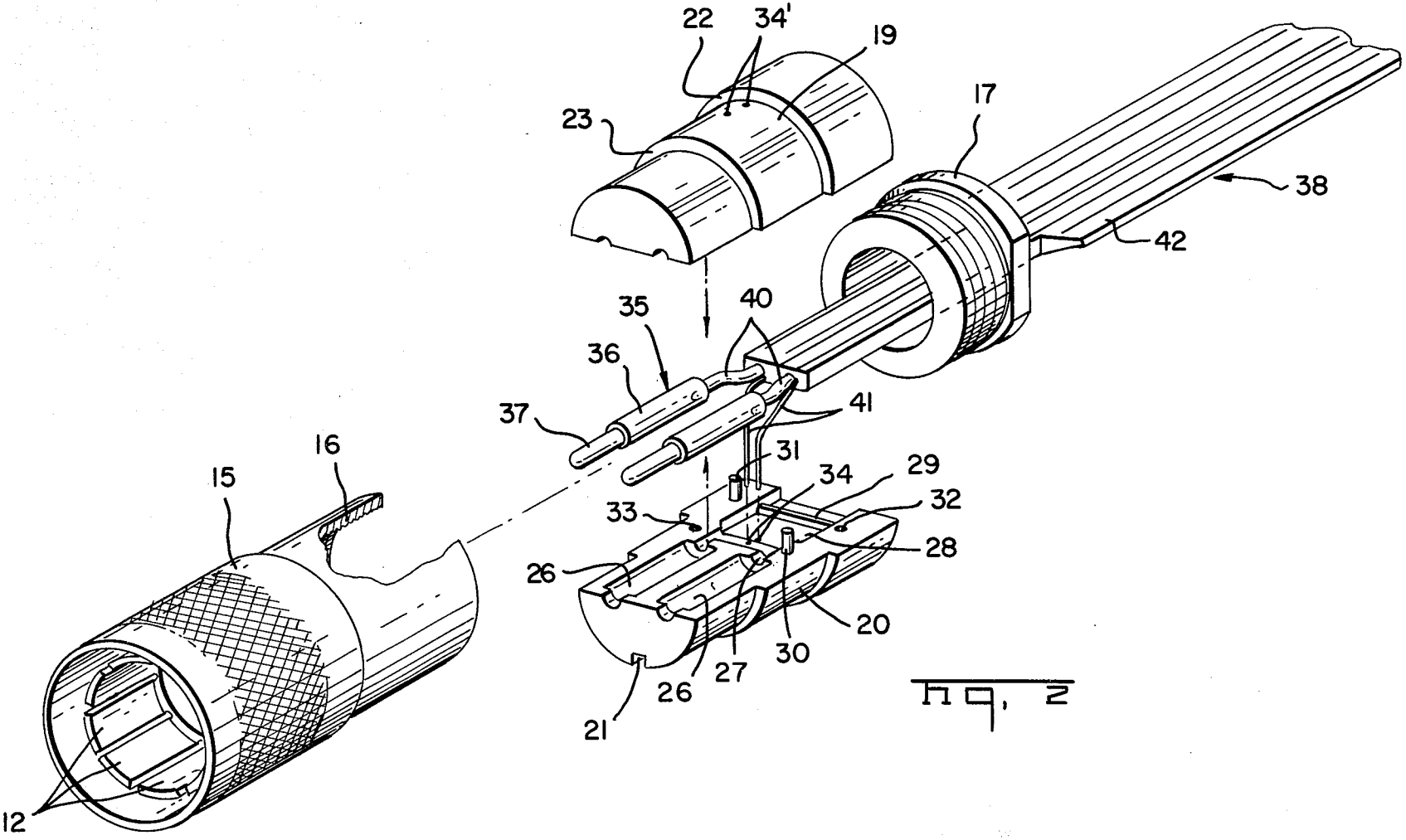
FIG. 2 is a partly exploded perspective view of the connector with terminal-locating block parts aligned for assembly.
Figure 7:
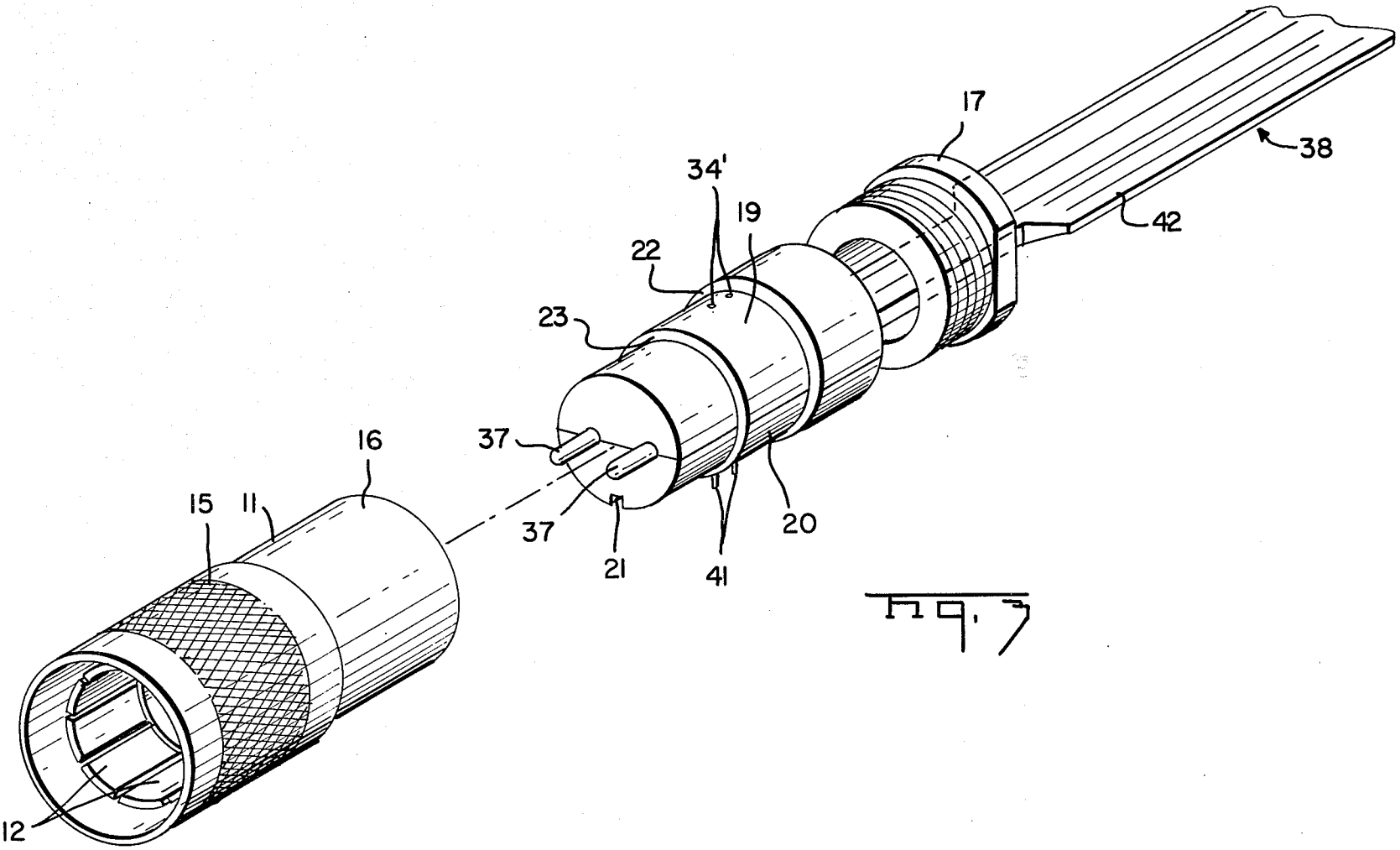

As shown in FIGS. 1 through 3, the connector comprises a generally tubular metal sleeve 11 from a forward, mating end of which extends a ring of contact spring fingers 12. A central portion 13 of the sleeve 11 is waisted providing a rearwardly facing shoulder 14 retaining a conventional, internally threaded, locking cap 15 rotatably mounted on the central portion 13, surrounding and spaced from the contact spring fingers. A rear end 16 of the sleeve 11 is internally threaded for receipt of a threaded metal retention bush 17. A key 18 extends inwardly of the central portion 13. Rearwardly facing locating shoulders 24 and 25 define a stepped internal configuration.

A terminal-locating block and cable clamp comprises first and second similar parts 19 and 20 each molded from plastic material into a generally cylindrical shape. A keyway 21 extends axially from a front end of one part 20, but the parts are otherwise identical. The parts are of axially stepped configuration, the steps being defined by forwardly-facing, locating shoulders 22 and 23. Each block is formed with terminal-receiving recesses 26 which communicate via conductor-receiving recesses 27 with a cable receiving recess 28 for a twin axial cable 38 at a rear of the locating block across which recess extends a clamping rib 29. Locating posts 30, 31 upstand from opposite sides of the block parts for receipt in locating sockets 33, 32, respectively. Two drain wire-receiving bores 34, 34' extend radially through respective block parts in axially spaced apart relation.

The twin axial cable is prepared for termination by exposing the conductors 40 and associated drain wires 41 and trimming excess insulation from the end to be terminated. The individual conductors are then connected to socket parts 36 of terminals 35 by soldering or other suitable means and the cable end threaded through the retention bush 17. The drain wires 41 are then carefully threaded into the bores 34 to protrude from the exterior of one block part 20, for example, and the terminals and cable located in the recesses 26 and 28, respectively, with pin portions 37 of the terminals projecting from the mating end. The other block part 19 is then assembled with block part 20 and located by the posts being received in the socket. The subassembly is then in the condition shown in FIG. 3 and can be inserted axially into the rear end 16 of the sleeve 11 and retained with the shoulders 22 and 24, and, 23 and 25 in abutment by the retention bush 17, as shown in FIG. 1.

During insertion into the sleeve, the free ends of the drain wires are wedged between the exterior of the body and the interior of the sleeve 11 effecting electrical connection between the cable shields and the sleeve.

Figure 4:
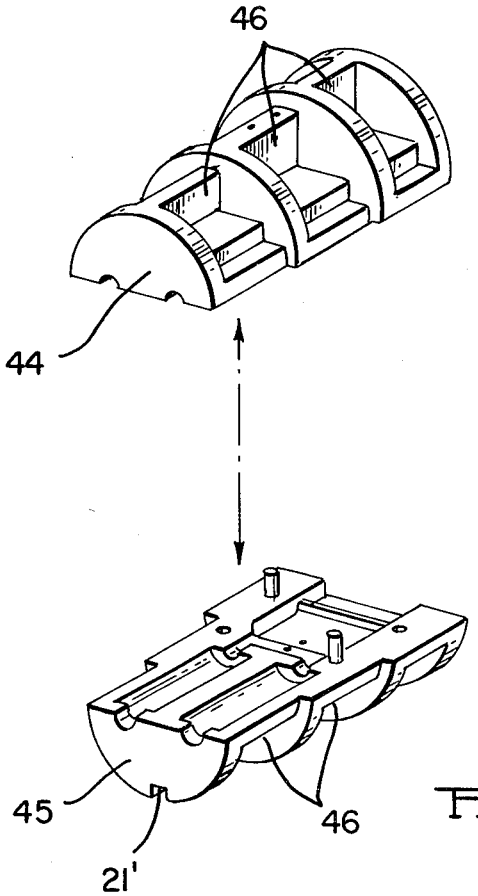

In modified block parts 44 and 45 shown in FIG. 4, recesses 46 are provided in each stepped part in the interests of economy of molding material and to provide a more uniform dielectric thickness surrounding the signal conductors improving the transmission characteristics at the connection.

We claim:

1. An electrical connector for terminating flat multiconductor shielded cable having a drain wire and comprising a metal sleeve having spring contact fingers extending from a forward mating end, a locking cap rotatably mounted on the sleeve to extend from the mating end surrounding the spring contact fingers, a generally cylindrical, insulating, terminal-locating block receivable as a close fit within the sleeve to locate terminals projecting from the mating end within and isolated from the spring contact fingers and a retention bush attachable to the rear end of the sleeve to retain the terminal-locating block in the sleeve, the block being bipartite, each part being generally hemicylindrical and being formed with terminal-receiving recesses at a mating end communicating with a cable-receiving recess at a rear end across which extends a cable-clamping means, a drain wire-receiving passageway extending radially through each part in communication with the cable receiving recess, whereby the drain wire may be terminated to the metal sleeve.

2. An electrical connector according to claim 1 in which a second radially-extending drain wire-receiving passageway is formed in the block axially spaced from the said passageways.

3. An electrical connector according to claim 1 in which the block increases in radial dimension as it extends rearwardly, portions of the block being hollow to provide a generally uniform dielectric thickness as it extends rearwardly.

4. An electrical connector according to claim 1 in which means are provided on the block parts to locate the parts together.

5. An electrical connector according to claim 4 in which a second radially-extending drain wire-receiving passageway is formed in a block axially spaced from the said passageways.

* * * * *